US007151241B2

(12) United States Patent
Kil

(10) Patent No.: US 7,151,241 B2
(45) Date of Patent: Dec. 19, 2006

(54) CONTROLLER AND HEATING WIRE CAPABLE OF PREVENTING GENERATION OF ELECTROMAGNETIC WAVES

(76) Inventor: Jong-Jin Kil, Kumkang APT 1-101, Sosa-dong 16-19, Bucheon-shi Kyungki-do (KR)

( * ) Notice: Subject to any disclaimer, the term of this patent is extended or adjusted under 35 U.S.C. 154(b) by 0 days.

(21) Appl. No.: 11/163,341

(22) Filed: Oct. 14, 2005

(65) Prior Publication Data

US 2006/0219701 A1 Oct. 5, 2006

(30) Foreign Application Priority Data

Apr. 1, 2005 (KR) ..... 10-2005-0027477

(51) Int. Cl.
*H05B 1/02* (2006.01)

(52) U.S. Cl. ..... 219/501; 219/219; 219/505; 219/518

(58) Field of Classification Search ..... 219/481, 219/490, 518, 117, 494, 505, 212, 501, 549, 219/497, 546, 504, 547; 307/117
See application file for complete search history.

(56) References Cited

U.S. PATENT DOCUMENTS 3,591,765 A * 7/1971 Owers ..... 219/212
4,008,367 A * 2/1977 Sunderhauf ..... 174/107
4,359,626 A * 11/1982 Potter ..... 219/490
5,151,577 A * 9/1992 Aspden ..... 219/528
5,218,185 A * 6/1993 Gross ..... 219/528
5,257,864 A * 11/1993 Nomura ..... 374/163
5,811,765 A * 9/1998 Nakagawa et al. ..... 219/497
6,982,857 B1 * 1/2006 Kim ..... 361/42
2002/0195442 A1 * 12/2002 Lee ..... 219/505
2003/0132212 A1 * 7/2003 Sowa et al. ..... 219/212
2005/0247700 A1 * 11/2005 Kochman et al. ..... 219/544

FOREIGN PATENT DOCUMENTS

JP 1998-162933 6/1998
JP 1998-262804 10/1998
JP 2000-030845 1/2000
JP 2000-030846 1/2000

* cited by examiner

*Primary Examiner*—Mark Paschall
(74) *Attorney, Agent, or Firm*—IPLA P.A.; James E. Bame

(57) ABSTRACT

The present invention relates, in general, to a temperature controller and heating cable used for electric heating bedding, such as an electric blanket, electric papered floor or electric fomentation device, or warmers and, more particularly, to a controller having a safety device, which can immediately shut off the supply of power when the disconnection, breakage or local overheating of a heating cable occurs while preventing the generation of an induced magnetic field and the leakage of an electric field, in warmers, such as simple bedding or fomentation devices that are operated by allowing a user to simply control a heating temperature to a high or low level without measuring the temperature of a separate heating cable. The controller, having a safety device, for blocking electromagnetic waves includes a switch unit, a heating current U-turn and detection unit, a fuse, and a cutting operation unit.

17 Claims, 12 Drawing Sheets

CONTROLLER AND HEATING WIRE CAPABLE OF PREVENTING GENERATION OF ELECTROMAGNETIC WAVES

BACKGROUND OF THE INVENTION

1. Field of the Invention

The present invention relates, in general, to a temperature controller and heating cable used for electric heating bedding, such as an electric blanket, electric papered floor or electric fomentation device, or warmers and, more particularly, to a controller having a safety device, which can immediately shut off the supply of power when the disconnection, breakage or local overheating of a heating cable occurs while preventing the generation of an induced magnetic field and the leakage of an electric field, in warmers, such as simple bedding or fomentation devices that are operated by allowing a user to simply control a heating temperature to a high or low level without measuring the temperature of a separate heating cable.

2. Description of the Related Art

For the sound sleep of human beings, the surrounding conditions of beds, such as temperature and humidity, are important factors. In typical homes, electric heating bedding or fomentation devices are frequently used to maintain beds at suitable temperatures. Such electric heating bedding or fomentation devices include a heating cable, which generates heat when power is supplied to the heating cable. Therefore, a temperature controller for sensing the temperature of the heating cable and controlling the supply of power according to the sensed temperature is generally provided.

Technology for automatically sensing the temperature of a heating cable, comparing the sensed temperature with a temperature set by a user and controlling the temperature was disclosed in Korean Pat. Application No. 2005-2886 filed by the present applicant. This technology is implemented by inserting a Negative Temperature Coefficient (NTC) thermistor between first and second electrical heating wires and determining whether heat is generated through the use of a signal generated by the NTC thermistor. However, high-grade bedding or fomentation devices for automatically sensing and controlling temperature have relatively high manufacturing costs.

Electric heating bedding or fomentation devices having relatively low manufacturing costs do not have a separate temperature sensing function, but allow a user to personally operate a switch so as to turn on or off power. Such electric heating bedding or fomentation devices are problematic in that, if power is turned on for a long period of time, electrical heating wires are disconnected or an insulating coating is melted, so that a fire may occur. Therefore, a circuit for sensing the temperature of a heating cable including electrical heating wires is generally included in the electric heating bedding or fomentation devices. In order to sense the temperature of the heating cable, a separate temperature sensing wire must be included in the heating cable. In this case, the thickness of the heating cable increases, so that it is inconvenient to produce and use the heating cable.

Accordingly, occasionally, a temperature sensing wire is not included in the heating cable, but a separate temperature sensor is placed near the heating cable to sense temperature. However, in this scheme, since it is difficult to sense that an insulator has melted and first and second electrical heating wires have shorted, or sense that respective electrical heating wires have disconnected, a simpler or more efficient safety device is required.

SUMMARY OF THE INVENTION

Accordingly, the present invention has been made keeping in mind the above problems occurring in the prior art, and an object of the present invention is to provide a controller, which can simply detect the melting or disconnection of electrical heating wires used for electric heating bedding, fomentation devices or warmers, while fundamentally preventing the generation of electromagnetic waves.

Another object of the present invention is to provide a controller having a safety device, which immediately shuts off the supply of power when electrical heating wires are overheated or broken down, and then disconnected.

A further object of the present invention is to provide a heating cable, which is capable of blocking harmful electromagnetic waves, such as an induced magnetic field or a leaked electric field.

In order to accomplish the above objects, the present invention provides a controller, having a safety device, for blocking electromagnetic waves, comprising a switch unit connected to a heating cable that blocks electromagnetic waves and includes a first electrical heating wire and a second electrical heating wire, the switch unit determining whether to supply power; a heating current U-turn and detection unit for causing power input from the first electrical heating wire to make a U-turn to the second electrical heating wire and detecting a signal; a fuse; and a cutting operation unit for cutting the fuse depending on the signal detected by the heating current U-turn and detection unit.

Preferably, the switch unit may comprise an off contact point for shutting off power; a high contact point for strongly heating the heating cable; and a low contact point for relatively weakly heating the heating cable.

Preferably, the heating current U-turn and detection unit may comprise a heating current U-turn unit including a U-turn resistor for connecting an end of the first electrical heating wire to an end of the second electrical heating wire; and a U-turn current detection unit including a transistor.

Preferably, the cutting operation unit may comprise a silicon controlled rectifier and a heating resistor, the transistor of the U-turn current detection unit may include a base connected to both the U-turn resistor and the first electrical heating wire, an emitter connected to both the U-turn resistor and the second electrical heating wire, and a collector connected to a gate of the silicon controlled rectifier, the silicon controlled rectifier of the cutting operation unit may include a cathode connected to the emitter of the transistor, and an anode connected to the heating resistor, and the heating resistor may cut the fuse when heat is generated.

Preferably, the heating current U-turn and detection unit may comprise a heating current U-turn unit including a U-turn rectifier for connecting an end of the first electrical heating wire to an end of the second electrical heating wire; and a U-turn current detection unit including a transistor.

Preferably, the heating current U-turn unit may comprise a diode having an anode connected to both the first electrical heating wire and a cathode of the U-turn rectifier, and a cathode connected to both the second electrical heating wire and an anode of the U-turn rectifier.

Preferably, the cutting operation unit comprises a silicon controlled rectifier and a heating resistor, the transistor of the U-turn current detection unit may include a base connected to both the U-turn rectifier and the first electrical heating wire, an emitter connected to both the U-turn rectifier and the second electrical heating wire, and a collector connected to a gate of the silicon controlled rectifier, the silicon controlled rectifier of the cutting operation unit may include a cathode connected to the emitter of the transistor, and an anode connected to the heating resistor, and the heating resistor may cut the fuse when heat is generated.

Preferably, the heating current U-turn and detection unit may comprise a solenoid for connecting an end of the first electrical heating wire to an end of the second electrical heating wire.

Preferably, the cutting operation unit may comprise a lead switch operating depending on whether power of the solenoid is connected or disconnected.

Preferably, the cutting operation unit may comprise a heating resistor, which is connected to the lead switch and cuts the fuse when heat is generated.

Further, the present invention provides a controller, having a safety device, for blocking electromagnetic waves, comprising a switch unit connected to a heating cable that blocks electromagnetic waves and includes a first electrical heating wire and a second electrical heating wire, the switch unit determining whether to supply power; a heating current U-turn and detection unit for causing power input from the first electrical heating wire to make a U-turn to the second electrical heating wire and detecting a signal; a fuse; and a disconnecting operation unit for disconnecting a power supply circuit depending on the signal detected by the heating current U-turn and detection unit.

Preferably, the cutting operation unit may comprise a silicon controlled rectifier and a cutting rectifier, the transistor of the U-turn current detection unit may include a base connected to both the U-turn resistor and the first electrical heating wire, an emitter connected to both the U-turn resistor and the second electrical heating wire, and a collector connected to a gate of the silicon controlled rectifier, and the silicon controlled rectifier of the cutting operation unit may include a cathode connected to the emitter of the transistor, and an anode connected to the cutting rectifier.

In addition, the present invention provides a heating cable for blocking electromagnetic waves, comprising a first electrical heating wire connected to a first terminal of a power source; an insulating coating applied to the first electrical heating wire while covering the first electrical heating wire; a second electrical heating wire wound around an outer circumferential surface of the insulating coating and provided with a first end connected to a second terminal of the power source; and an external coating for covering the insulating coating and the second electrical heating wire.

Preferably, the external coating may be made of a conductive synthetic resin material, and may completely cover both the insulating coating and the second electrical heating wire to prevent the insulating coating and the second electrical heating wire from being externally exposed.

Preferably, the external coating may comprise a conductive coating made of a conductive synthetic resin material; and an insulating coating for covering an outside of the conductive coating.

Preferably, the second electrical heating wire may be a lead wire, a metallic strip or metallic shielding element wound around an outside of the insulating coating.

Preferably, an aluminum plate may be wound around an outside of the insulating coating, and the second electrical heating wire may be wound around an outside of the aluminum plate.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, the construction of the present invention is described in detail with reference to the embodiments of the present invention shown in the attached drawings.

Figure 1:
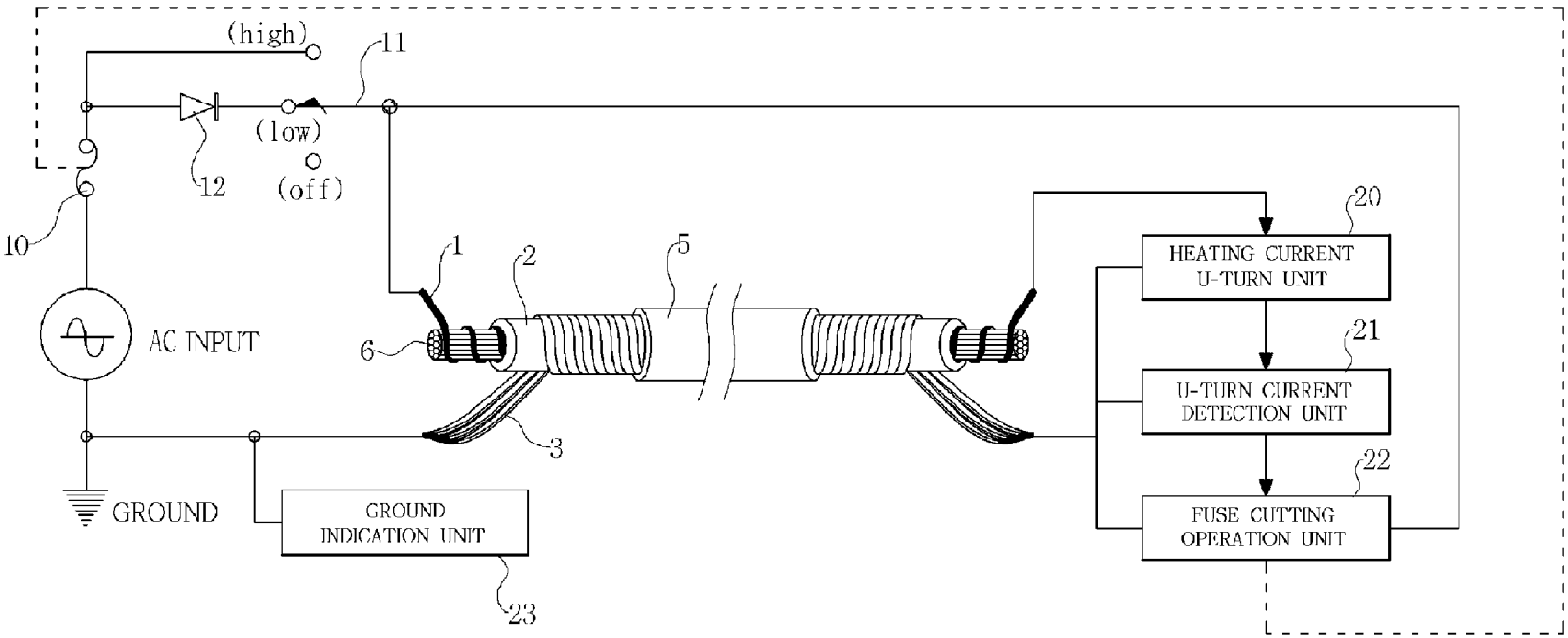
FIG. 1 is a view showing the construction and the circuit of a controller according to the present invention.

FIG. 1 is a view showing the construction and the circuit of a controller according to the present invention. Referring to FIG. 1, one end of a power source is connected to a first electrical heating wire 1, and the other end thereof is connected to a second electrical heating wire 3 and grounded. A temperature fuse 10 is disposed between the power source and the first electrical heating wire 1, and a power selection switch 11 is connected to the rear side of the temperature fuse 10. In the power selection switch 11, a power terminal positioned at a center C selectively comes into contact with a high temperature terminal (high), a lower temperature terminal (low), and an off terminal (off) depending on a user's selection. A front side of the low temperature terminal is connected to a rectifier. A cathode of the rectifier is connected to the low temperature terminal, and an anode thereof is connected to a power source side. Since only half-wave power is supplied to the low temperature terminal by the rectifier, only 50% of power is supplied to the low temperature terminal compared to the high temperature terminal. The high temperature terminal allows full-wave power to be supplied to an electrical heating wire, so that the amount of heat generated increases compared to the case in which the low temperature terminal is selected.

Current, having passed through the power selection switch 11, is input to the first electrical heating wire 1 to generate heat, is output to the other end of the heating cable, and is then input to the second electrical heating wire 3 of the heating cable placed on an opposite side through a heating current U-turn unit 20. The current, having passed through the second electrical heating wire 3, is returned to the power source.

A heating current U-turn and detection unit includes the heating current U-turn unit 20 and a U-turn current detection unit 21. The heating current U-turn unit 20 is connected to the U-turn current detection unit 21 and a fuse cutting operation unit 22. The U-turn current detection unit 21 monitors whether U-turn current flows normally, and the fuse cutting operation unit 22 functions to cut the temperature fuse 10 or shut off the supply of current depending on a fault signal generated by the U-turn current detection unit 21. The ground indication unit 23 is used to indicate whether the second electrical heating wire 3 is normally connected to the ground. Through the ground, the second electrical heating wire 3 can perform a shielding operation to block the outflow of an electric field. Such a construction is further clarified by referring to circuit diagrams in and subsequent to FIG. 2.

Figure 2:
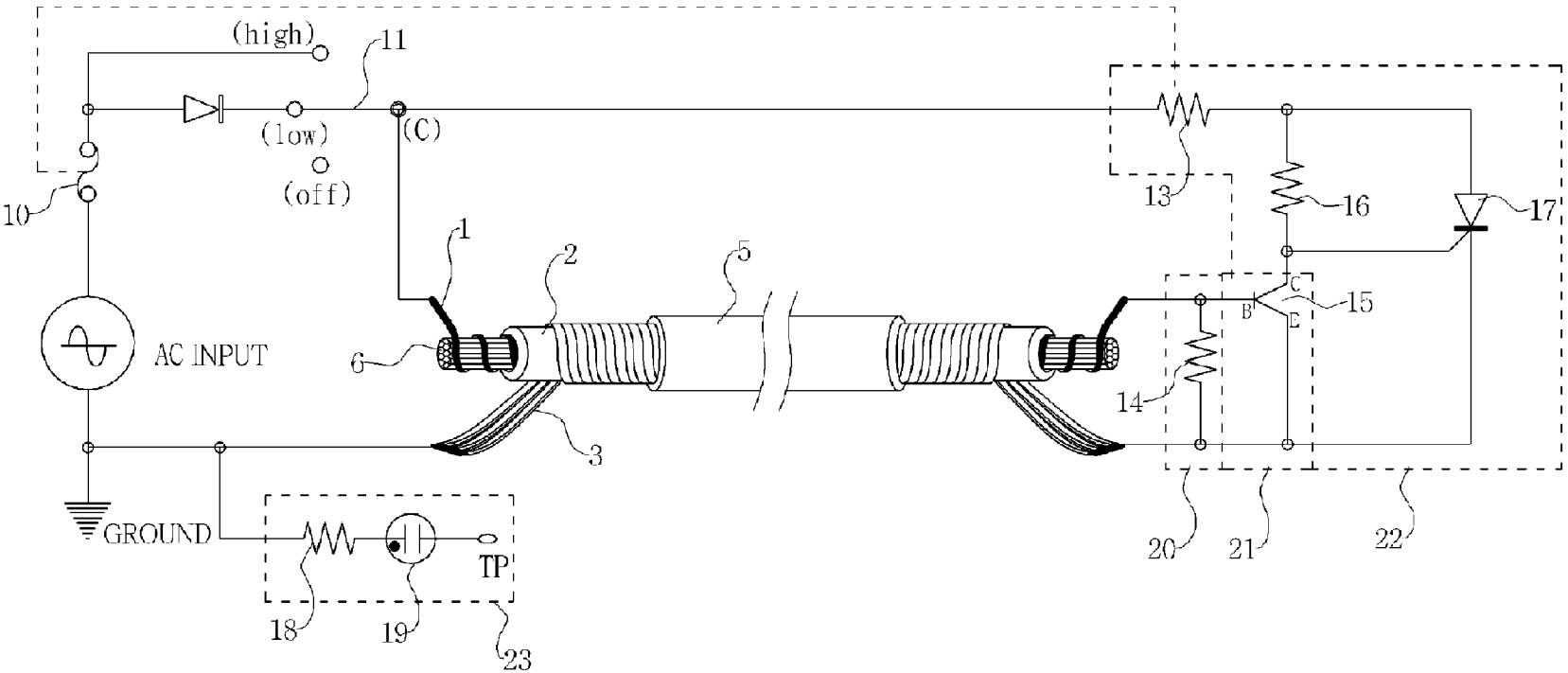
FIG. 2 is a view showing an embodiment of a controller circuit of the present invention, in which a heating current U-turn unit includes a resistor.
Figure 3:
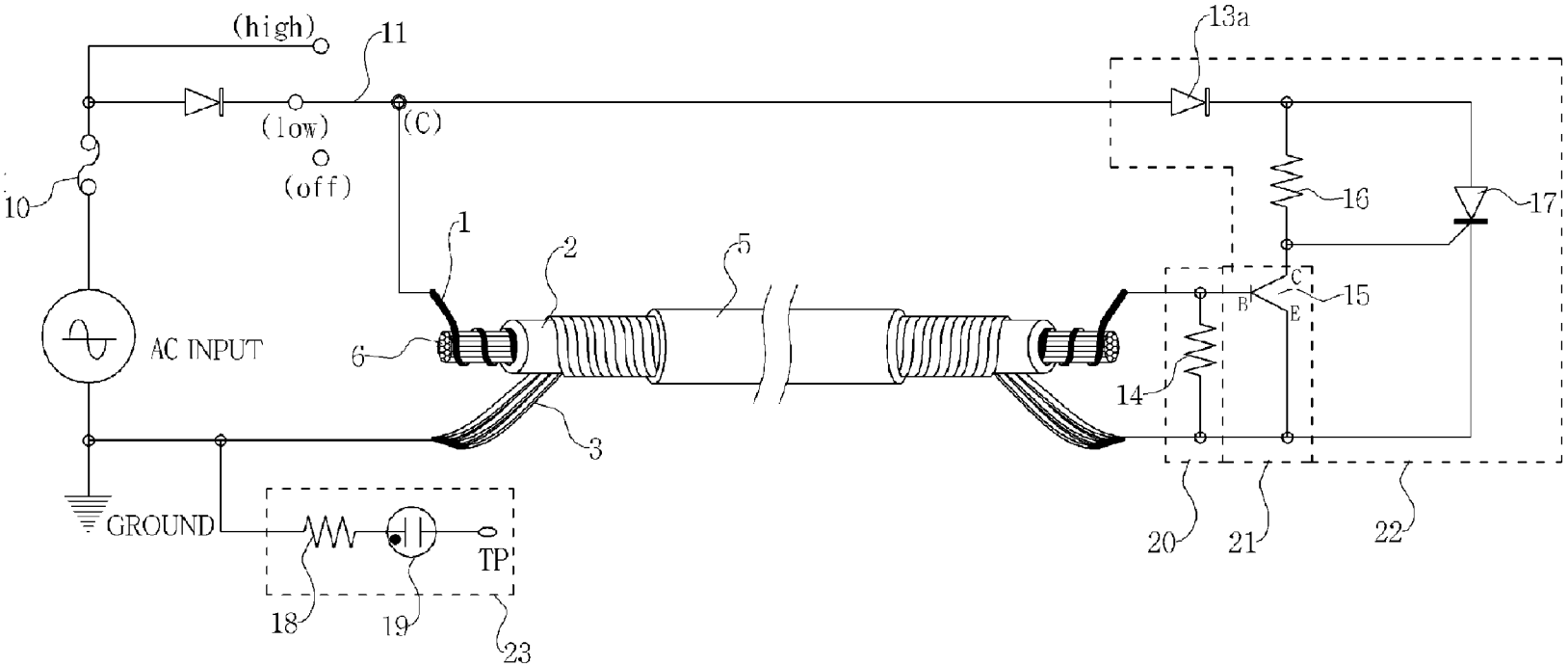
FIG. 3 is a view showing an embodiment of a controller circuit of the present invention, in which a fuse cutting operation unit includes a diode.

FIG. 2 is a view showing an embodiment of a controller circuit of the present invention, in which a heating current U-turn unit includes a heating resistor, and FIG. 3 is a view showing an embodiment of a controller circuit of the present invention, in which a fuse cutting operation unit includes a disconnecting diode. Referring to FIGS. 2 and 3, a heating current U-turn unit 20 includes a U-turn resistor 14, which is connected in series between first and second electrical heating wires 1 and 3 and functions to cause current flowing through the first electrical heating wire 1 to make a U-turn toward the second electrical heating wire 3.

The heating cable includes the first and second electrical heating wires 1 and 3, and includes an insulating coating 2, made of a synthetic resin material, such as polyethylene or nylon having a fixed temperature melting and insulating performance, between the first electrical heating wire 1 and the second electrical heating wire 3. Therefore, if a certain temperature is reached, the insulating coating 2 is melted.

An end of the first electrical heating wire 1 connected to the U-turn resistor 14 is connected to a transistor 15 of the U-turn current detection unit 21. The base B of the transistor 15 is connected to both the first electrical heating wire 1 and the U-turn resistor 14, and the collector C of the transistor 15 is connected to the gate of a Silicon-Controlled Rectifier (SCR) 17 of the fuse cutting operation unit 22. The emitter E of the transistor 15 is connected to both the second electrical heating wire 3 and the cathode of the SCR 17. A gate trigger resistor 16 is disposed between the anode and gate of the SCR 17. The anode of the SCR 17 is connected to a heating resistor 13, which functions to cut the temperature fuse 10.

A method of grounding the second electrical heating wire 3 is implemented to ground the second electrical heating wire 3 to a ground line of two lines of a commercial AC power source. The ground indication unit 23 is constructed in such a way that a resistor 18, a neon tube 19 and a test point TP are connected in series with each other. The second electrical heating wire 3 performs a shielding function. One end of the second electrical heating wire 3 is connected to the power source, and the ground indication unit 23 is connected to the one end of the second electrical heating wire 3, so that the grounded state of the second electrical heating wire 3 is examined by bringing the tip of a finger into contact with the test point TP and determining whether the neon tube 19 is turned on or not. If the neon tube 19 is turned on, it is determined that the second electrical heating wire 3 is not grounded. On the contrary, if AC power is reversely supplied and the neon tube 19 is not turned on, the second electrical heating wire 3 is grounded and performs a shielding function, thus blocking the leakage of an electric field.

The operating method of the circuit having the above construction is described as follows. A user heats the heating cable by adjusting a power consumption level to high or low through the switch unit. When a current, input to the first electrical heating wire 1, is returned to the second electrical heating wire 3 by the U-turn resistor 14, the directions of currents are opposite each other, so that an induced magnetic field is offset.

Meanwhile, in order to prevent charges from being charged to the outside of the heating cable, the second electrical heating wire 3 must be grounded. For this operation, while the tip of a finger comes into contact with the test point TP of the ground indication unit 23, the direction in which power is to be supplied is set. Due to the grounding operation, an electric field formed on the entire surface of the heating cable is blocked.

During normal operation of the heating cable, the voltage induced at the U-turn resistor 14 turns on the transistor 15, so that the gate current of the SCR 17 is bypassed to the collector and emitter of the transistor 15, thus causing the anode current of the SCR 17 to be turned off. Therefore, the heating resistor 13 is not heated.

If the first electrical heating wire 1 is overheated during use, the insulating coating 2, having a property that it is melted at a rated temperature, is melted, so that the first electrical heating wire 1 and the second electrical heating wire 3 come into contact with each other. Further, there may occur the case in which a part of the first or second electrical heating wire 1 or 3 is disconnected due to breakage during use. At this time, the voltage induced at the U-turn resistor 14 is removed, and the transistor 15 is turned off. As the gate current of the SCR 17 flows, the anode current of the SCR 17 is turned on, and the heating resistor 13 is heated, so that the temperature fuse 10 is cut, thus shutting off the flow of power.

Further, a diode 13*a* may be used instead of the heating resistor 13 of the fuse cutting operation unit 22, as shown in FIG. 3. If an overcurrent instantaneously flows through the diode 13*a* as the diode 13*a* is shorted, the temperature fuse 10 is broken and the supply of power is shut off. If the time required for the heating resistor 13 to heat and cut the temperature fuse 10 is about 2 to 10 seconds, there is an advantage in that, if the diode 13*a* is used, the diode 13*a* immediately reacts and the temperature fuse 10 is broken, so that the supply of current is shut off.

The present invention having the above construction is advantageous in that it can instantaneously sense a short-circuit caused by overheating and the disconnection of the electrical heating wire and can shut off power merely by connecting the transistor to the SCR. In particular, since a circuit can be implemented using only a simple construction, excellent effects can be obtained compared to a conventional complicated construction and scheme.

Figure 4:
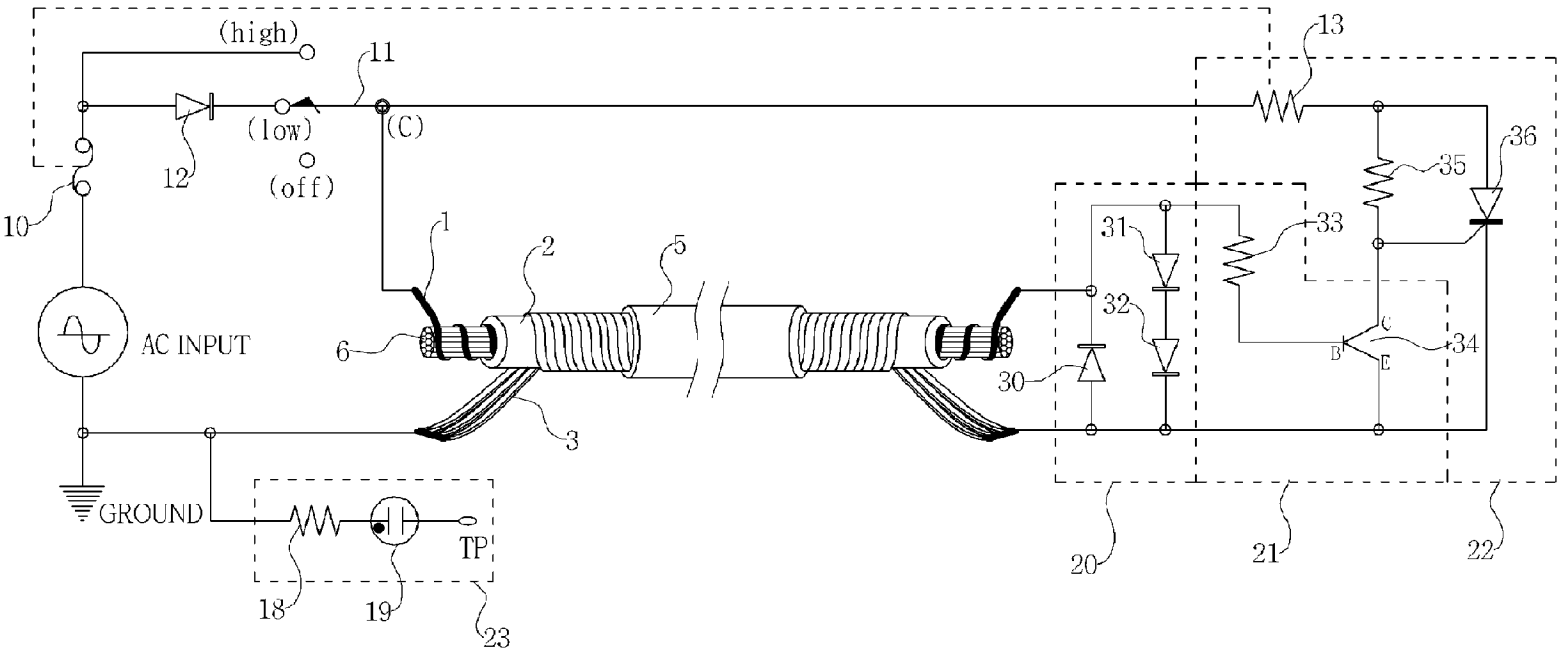
FIG. 4 is a view showing an embodiment of a controller circuit of the present invention, in which a heating current U-turn unit includes a diode.

FIG. 4 is a view showing an embodiment of a controller circuit of the present invention, in which a heating current U-turn unit includes a diode. Referring to FIG. 4, a diode 30 can be used in a heating current U-turn unit 20, instead of a U-turn resistor. Diodes 30, 31 and 32 of the heating current U-turn unit 20 perform the same function as the U-turn resistor 14. Because the signal voltage of the U-turn current detection unit 21 is lower than that of the case in which the U-turn resistor 14 is used, the two diodes 31 and 32 on a signal voltage detection side are connected in series and used so as to increase the signal voltage. A resistor 33 used in this case protects the base of a transistor 34.

The operating method when the diode 30 is used is similar to that when the U-turn resistor 14 is used. If U-turn current does not flow, a signal voltage at the base of the transistor 34 is 0V, so that emitter and collector currents of the transistor 34 are cut off. At this time, current flowing through a gate trigger resistor 35 flows into an SCR 36, thereby enabling the SCR 36 to be turned on. Therefore, as current also flows through the heating resistor 13, heat is generated, thus causing the temperature fuse 10 to be cut.

Figure 5:
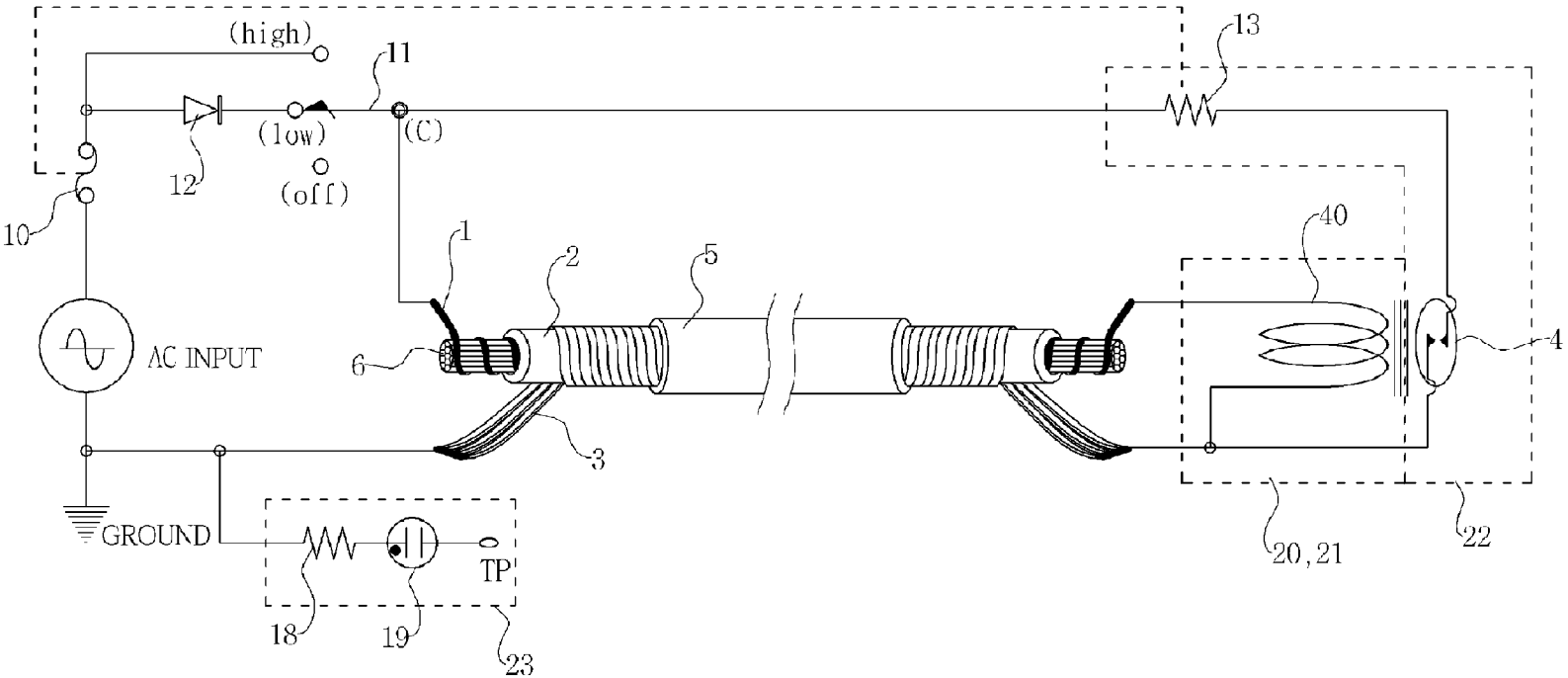
FIG. 5 is a view showing an embodiment of a controller circuit of the present invention, in which a heating current U-turn and detection unit includes a solenoid.

FIG. 5 is a view showing an embodiment of a controller circuit of the present invention, in which a heating current U-turn and detection unit includes a solenoid. Referring to FIG. 5, the function of causing a heating current to make a U-turn and detecting the U-turn current is performed by a solenoid 40 and a lead switch 41. The solenoid 40 and the lead switch 41 function as a kind of relay. Depending on the magnetic force generated by the solenoid 40, the lead switch 41 changes, and on/off operation of the lead switch 41 is determined. That is, a magnetic contact-type magnetic lead switch 41 is placed at a nearby location, reachable by the magnetic field of the solenoid 40. One contact point of the lead switch 41 is connected to the second electrical heating wire 3, and the other contact point of the lead switch 41 is connected to the heating resistor 13. In this case, if a U-turn current does not flow through the solenoid 40, the magnetic field disappears, and the contact points of the lead switch 41 come into contact with each other, so that current flows through the heating resistor 13, connected to the power source, and heat is generated, thus causing the temperature fuse 10 to be melted.

Through the above-described controller, the present invention provides a function of immediately detecting the case, in which an electrical heating wire is overheated, an insulating coating is melted and the electrical heating wire is shorted, or in which the electrical heating wire itself is disconnected, and of shutting off the supply of power. In particular, this function is suitably used for inexpensive electric heating bedding or fomentation devices having a simple structure, thus obtaining an advantage in that an inexpensive and reliable safety device can be provided.

Hereinafter, various structures of a heating cable, used together with the controller of the present invention, are described (the same reference numerals are used through embodiments, which will be presented below, to designate the same or similar components, and only alphabet letters are attached to the reference numerals in different embodiments).

Figure 6:
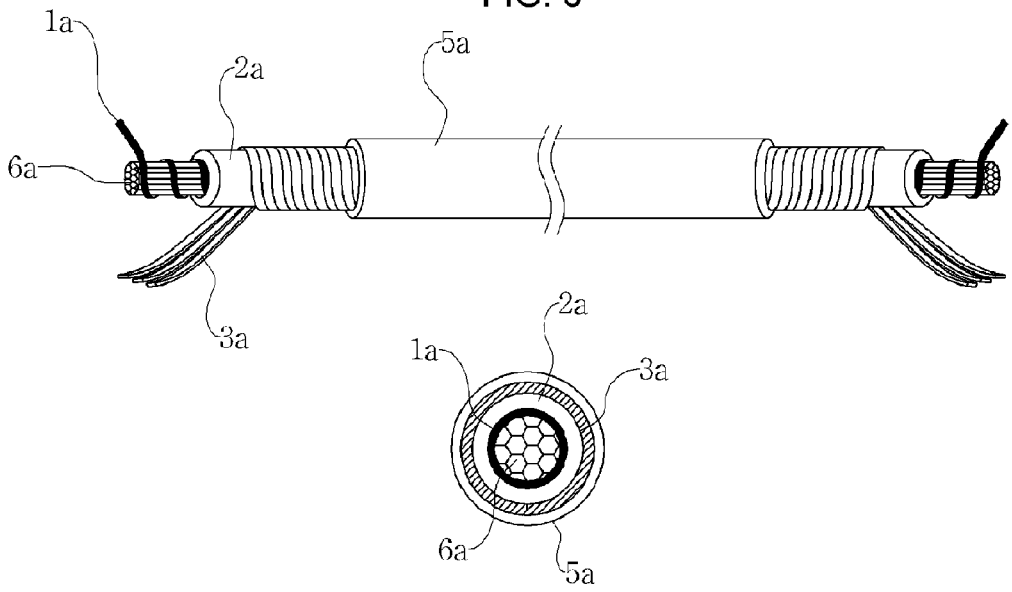
FIG. 6 is a view showing an embodiment of a heating cable of the present invention, in which a thin conducting wire wound around a core thread is used as a first electrical heating wire and a wound metallic strip is used as a second electrical heating wire.

FIG. 6 is a view showing an embodiment of a heating cable of the present invention, in which a thin conducting wire wound around a core thread is used as a first electrical heating wire and a wound metallic strip is used as a second electrical heating wire. Referring to FIG. 6, the heating cable includes a core thread 6*a* made of polyester, etc., a first electrical heating wire 1*a* spirally wound around the outer circumferential surface of the core thread 6*a* in any one direction along a longitudinal direction, an insulating coating 2*a* applied to the first electrical heating wire 1*a* and the core thread 6*a* while covering the outer circumferential surfaces thereof, a second electrical heating wire 3*a* spirally wound around the outer circumferential surface of the insulating coating 2*a* through a plurality of members, and an insulating coating 5*a* made of a synthetic resin material and applied to the insulating coating 2*a* and the second electrical heating wire 3*a* while covering the insulating coating 2*a* and the second electrical heating wire 3*a*.

The second electrical heating wire 3*a* is grounded and the resistance value thereof is decreased, so that an electric field can be efficiently blocked. If the second electrical heating wire 3*a* is spirally wound using a tape-shaped metallic strip or copper strip, the second electrical heating wire 3*a* can be sparsely wound, be densely wound or be wound to cause part of the heating wire to overlap each other. The metallic strip may have a large width, or two or more metallic strips may be wound in parallel in the shape of a tape.

If the total length of the heating cable is short, it may be convenient to wind a tape-shaped metallic strip without using two lead wires. For example, since a heating cable, used for a fomentation device, etc. that locally heats a human body, is short, it is possible to simply wind a metallic strip and use it. In the case of a metallic strip, the leakage of electromagnetic waves is completely prevented, and the entire length required for shielding is shortened, so that the electrical resistance thereof is greatly decreased. Further, the metallic strip is not easily bent, but maintains flexibility due to the wound shape thereof. Further, since a winding interval is widened, the entire winding can be performed only a small number of times, and then the length of the metallic strip is shortened. Therefore, there is an advantage in that an electrical resistance value is decreased, and the time required for winding is decreased, thus improving productivity.

Figure 7:
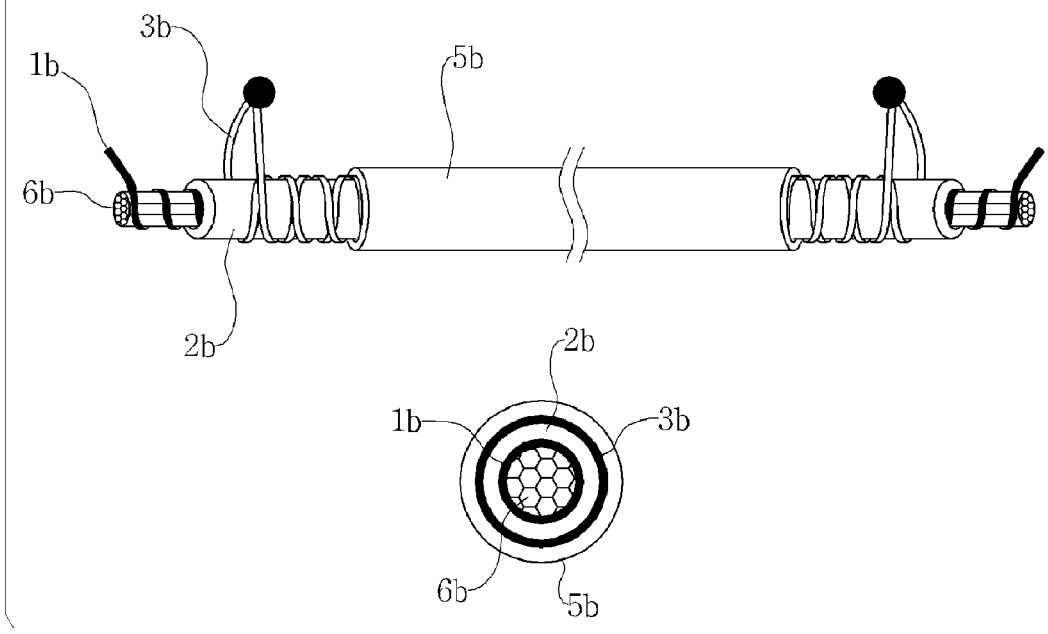
FIG. 7 is a view showing an embodiment of the heating cable of FIG. 6, in which two lead wires, wound to cross each other, are used as a second electrical heating wire.
Figure 8:
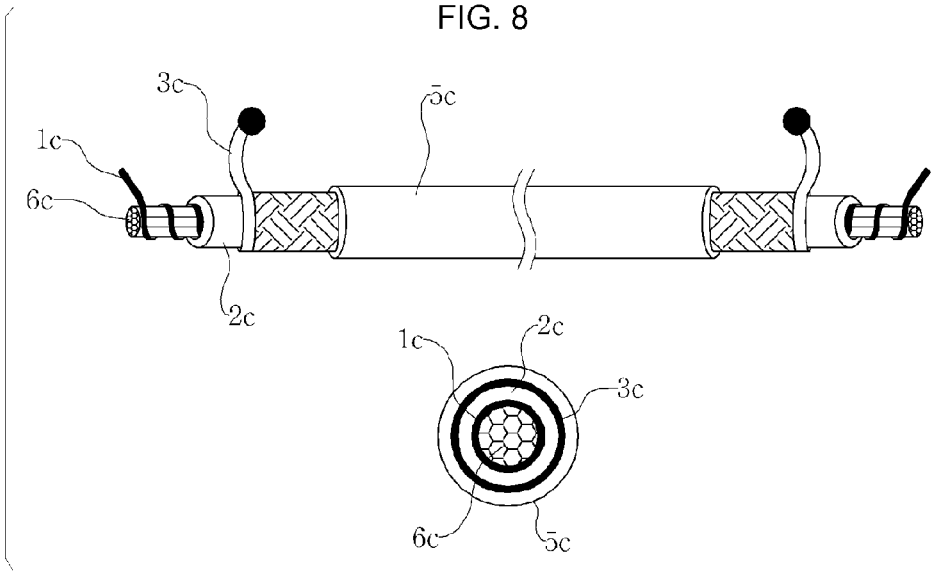
FIG. 8 is a view showing an embodiment of the heating cable of FIG. 6, in which a wound metallic braid element is used as the second electrical heating wire.
Figure 9:
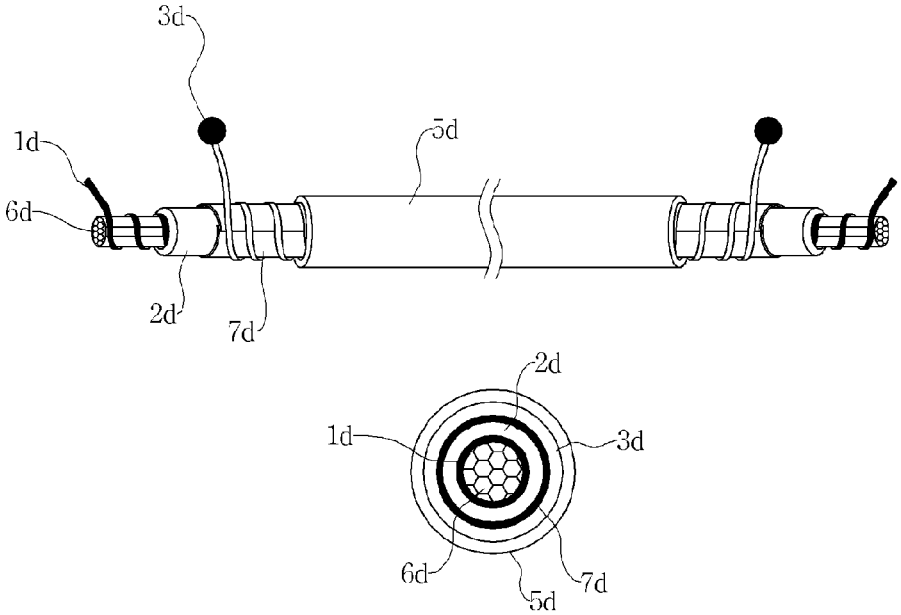
FIG. 9 is a view showing an embodiment of the heating cable of FIG. 6, in which a metallic plate is wound inside the second electrical heating wire.

FIG. 7 is a view showing an embodiment of the heating cable of FIG. 6, in which two lead wires, wound to cross each other, are used as a second electrical heating wire, FIG. 8 is a view showing an embodiment of the heating cable of FIG. 6, in which a wound metallic braid element is used as the second electrical heating wire, and FIG. 9 is a view showing an embodiment of the heating cable of FIG. 6, in which a metallic plate is wound inside the second electrical heating wire. Referring to FIGS. 7 to 9, two lead wires, which are wound to cross each other in opposite directions, are used as a second electrical heating wire 3*b*, or a braid element 3*c* braided with metal is used as a second electrical heating wire. Further, an additional metal or aluminum plate 7*d* is provided inside a second electrical heating wire 3*d*. The metallic braid element 3*c* formed by braiding metal covers an insulating coating 2*c*, and part of the rod wires of the metallic braid element 3*c* are drawn out from both ends of the braid element.

Operating principles are the same as those of the above embodiment, but there is only a difference in the construction of the second electrical heating wire. The metallic braid element 3*c* is formed by twisting a plurality of metallic strips and adjusting the width of each of the metallic strips to meet each capacity. Part of the rod wires of the metallic braid element 3*c* are drawn out to allow current to flow therethrough. The shape of the metallic braid element 3*c* is not limited. The metallic braid element 3*c* may be formed in the shape of a tape that is formed lengthwise to have a certain width, and may be spirally wound. Further, a plurality of thin metallic strips may be collected in parallel, be constructed in the shape of a tape and be spirally wound. The metallic braid element 3*c* performs a shielding operation to block an electric field.

The metallic plate or the aluminum plate 7*d* is formed to cover the insulating coating 2*d* and performs a shielding operation to block an electric field. The lead wire 3*d*, wound around the outer circumferential surface of the aluminum plate 7*d*, is used to drain charges, charged on the aluminum plate 7*d*, thereby decreasing an electrical resistance value, and consequently decreasing potential between the aluminum plate and the ground. Aluminum has flexibility, is easily processed, and is cheaper than copper. However, when an electric circuit is intended to be constructed by connecting aluminum to another metal through soldering, soldering is not sufficiently performed, so that it is preferable that aluminum be used together with the lead wire 3*d* for soldering.

Figure 10:
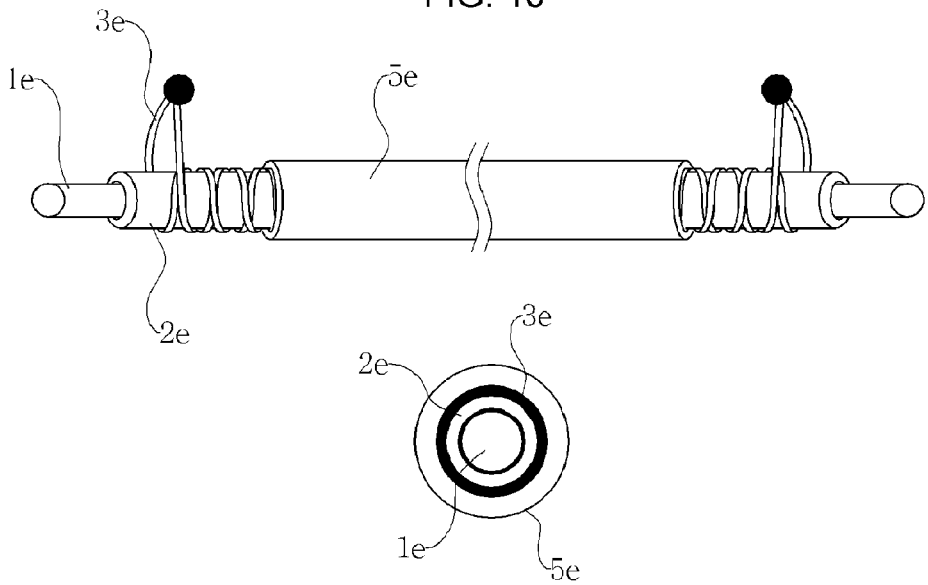
FIG. 10 is a view showing an embodiment of a heating cable of the present invention, in which an electrical heating conducting wire is used as the first electrical heating wire and two lead wires, wound to cross each other, are used as the second electrical heating wire.
Figure 11:
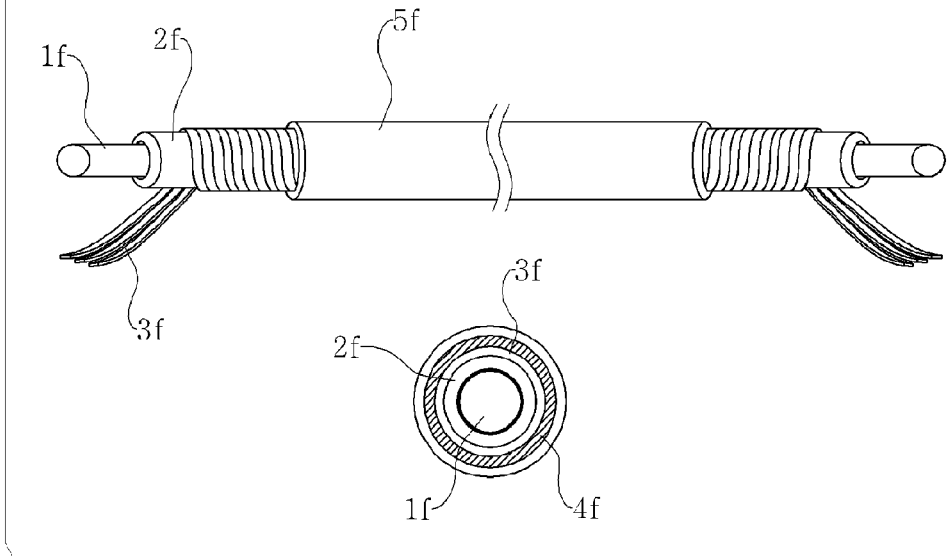
FIG. 11 is a view showing an embodiment of the heating cable of FIG. 10, in which a wound metallic strip is used as the second electrical heating wire.

FIG. 10 is a view showing an embodiment of a heating cable of the present invention, in which an electrical heating conducting wire is used as the first electrical heating wire and two lead wires, wound to cross each other, are used as the second electrical heating wire, and FIG. 11 is a view showing an embodiment of the heating cable of FIG. 10, in which a wound metallic strip is used as the second electrical heating wire. Referring to FIGS. 10 and 11, most components are the same as those of above embodiments, but there is a difference in that metallic electrical heating conducting wires 1*e* and 1*f*, which are central, linear and solid, are used instead of a scheme of winding an electrical heating wire around a core thread made of a synthetic resin material as the first electrical heating wire. Therefore, the operating principles of the heating cable are the same as the above embodiments, but there is a difference in bending or breaking characteristics because the metallic electrical heating conducting wires 1*e* and 1*f*, which are linear and solid, are relatively thick conducting wires.

Figure 12:
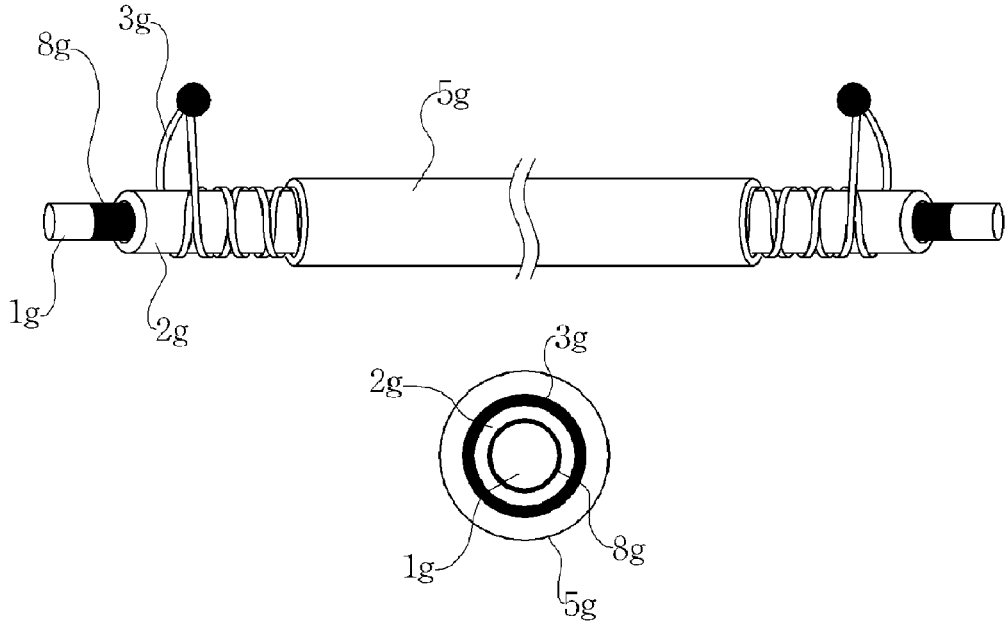
FIG. 12 is a view showing an embodiment of the heating cable of FIG. 10, in which an electrical heating conducting wire, the outer surface of which is coated with enamel, is used as the first electrical heating wire.
Figure 13:
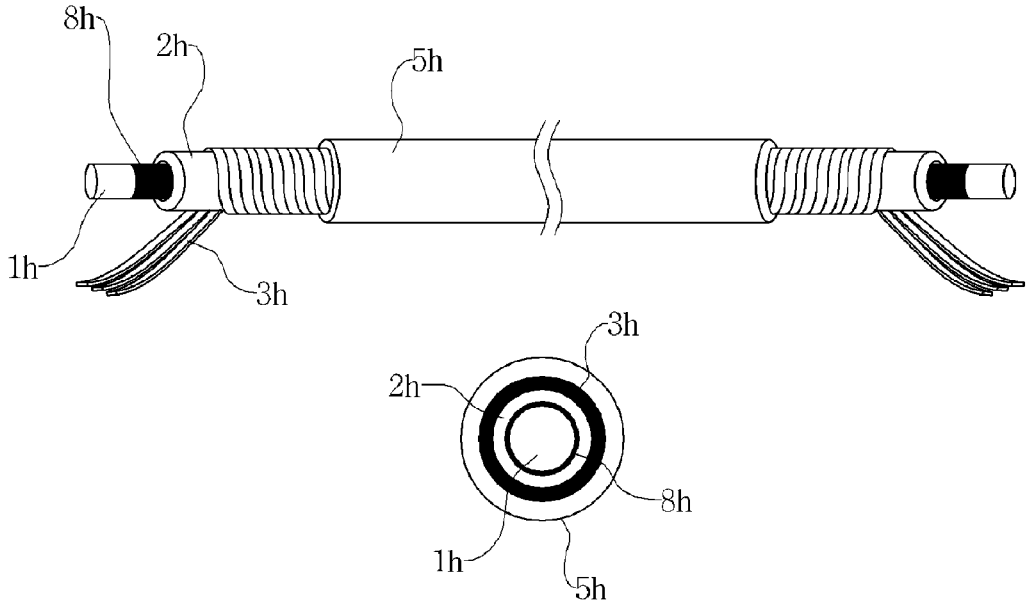
FIG. 13 is a view showing an embodiment of the heating cable of FIG. 12, in which a wound metallic strip is used as the second electrical heating wire.

FIG. 12 is a view showing an embodiment of the heating cable of FIG. 10, in which an electrical heating conducting wire, the outer surface of which is coated with enamel, is used as the first electrical heating wire, and FIG. 13 is a view showing an embodiment of the heating cable of FIG. 12, in which a wound metallic strip is used as the second electrical heating wire. Referring to FIGS. 12 and 13, most components are the same as those of the above-described embodiments, but the outer surfaces of the linear and solid metallic heating conducting wires 1*g* and 1*h* are coated with enamel 8*g* and 8*h*, respectively, thus improving an insulating function. Due to the enamel coating 8*g* and 8*h*, sufficient insulation is possible even though the insulating coatings 2*g* and 2*h* are further thinned, so the entire thickness of the heating cable can be decreased.

Figure 14:
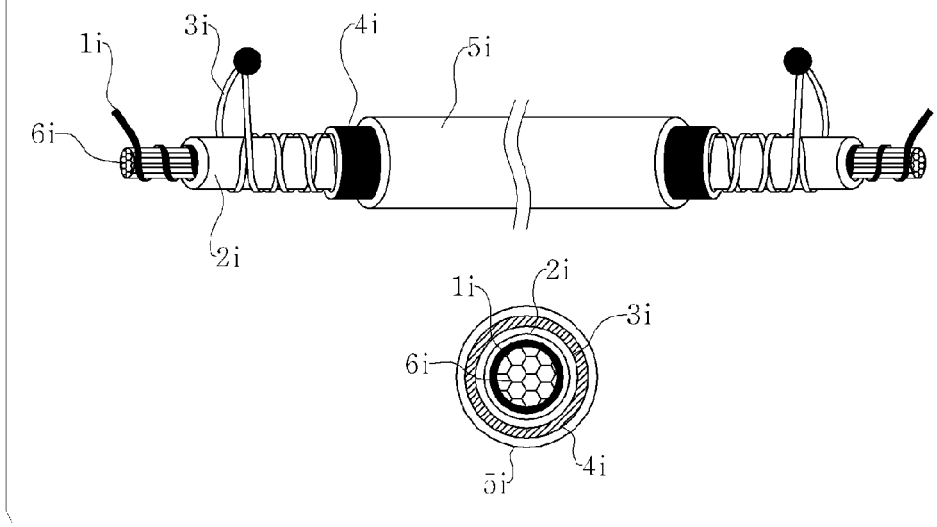
FIG. 14 is a view showing an embodiment of a heating cable of the present invention, in which a conductive coating is provided.
Figure 15:
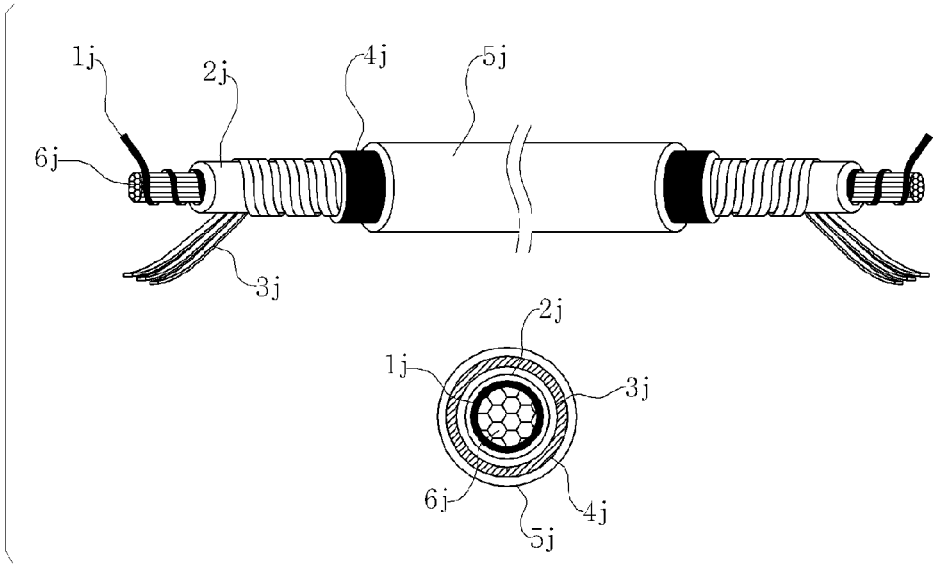
FIG. 15 is a view showing an embodiment of the heating cable of FIG. 14. in which a wound metallic strip is used as the second electrical heating wire.
Figure 16:
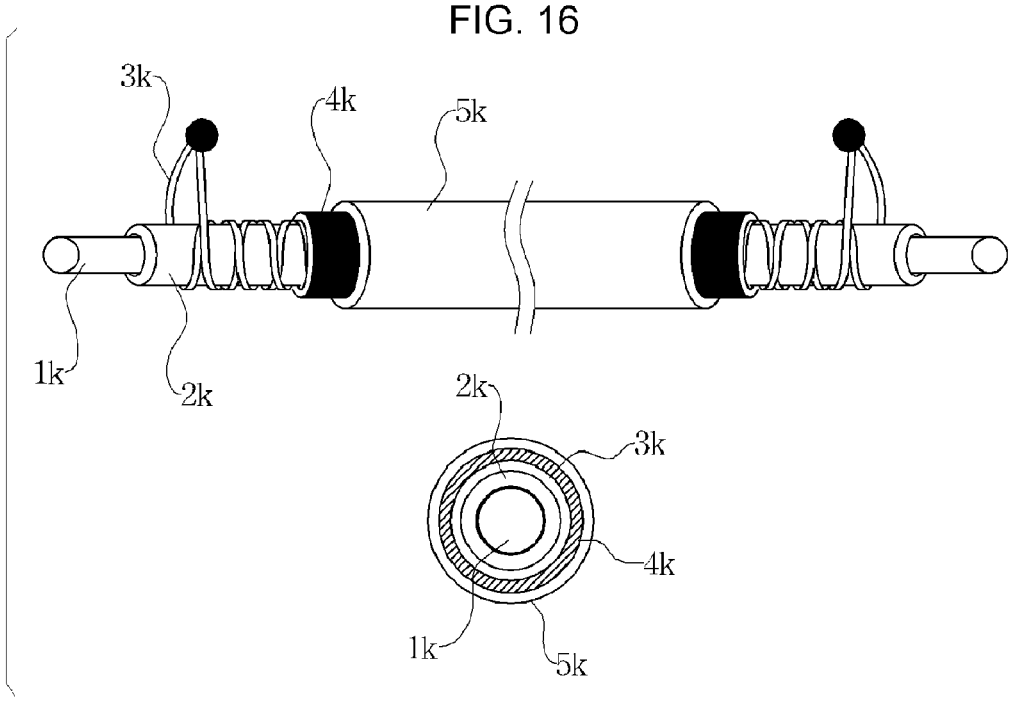
FIG. 16 is a view showing an embodiment of the heating cable of FIG. 10, in which a conductive coating is provided.
Figure 17:
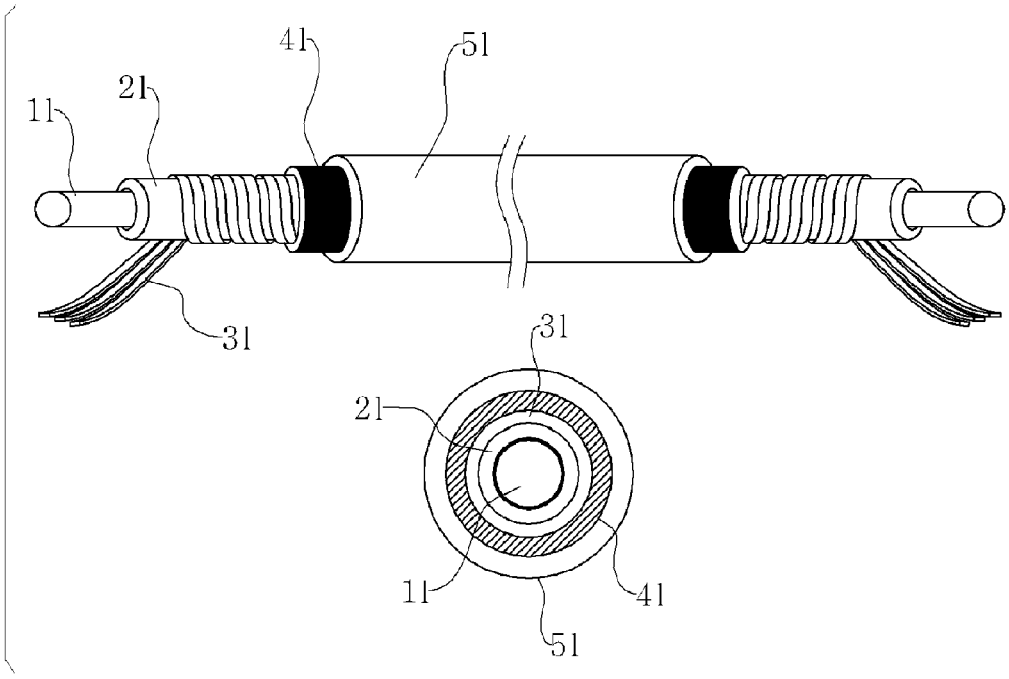
FIG. 17 is a view showing an embodiment of the heating cable of FIG. 11, in which a conductive coating is provided.

FIG. 14 is a view showing an embodiment of a heating cable of the present invention, in which a conductive coating is provided, FIG. 15 is a view showing an embodiment of the heating cable of FIG. 14. in which a wound metallic strip is used as the second electrical heating wire, FIG. 16 is a view showing an embodiment of the heating cable of FIG. 10, in which a conductive coating is provided, and FIG. 17 is a view showing an embodiment of the heating cable of FIG. 11, in which a conductive coating is provided. Referring to FIGS. 14 to 17, most components are the same as those of the above embodiments, but there is a difference in that a conductive coating 4*i*, 4*j*, 4*k* or 4*l* made of a conductive material is added to the outside of the second electrical heating wire. According to circumstances, an external coating 5*i*, 5*j*, 5*k* or 5*l* may be replaced with the conductive coating 4*i*, 4*j*, 4*k* or 4*l* without using the external coating 5*i*, 5*j*, 5*k* or 5*l*.

An electric field may leak to a space on which the second electrical heating wire 3*i*, 3*j*, 3*k* or 3*l* is not wound, and the conductive coating 4*i*, 4*j*, 4*k* or 4*l* blocks the leaked electric field. Meanwhile, if a metallic strip having a large width is used, or if a plurality of lead wires is wound several times, a shielding operation is performed over a wide area. Accordingly, the leakage of an electric field to the outside is decreased, and the conductive coating 4*i*, 4*j*, 4*k* or 4*l* blocks only a slight leaked electric field. Therefore, since the leaked electric field blocked by the conductive coating 4*i*, 4*j*, 4*k* or 4*l* is relatively very small, the body of the user is not greatly influenced by the leaked electric field even though the separate external coating 5*i*, 5*j*, 5*k* or 5*l* is not used for insulation.

Figure 18:
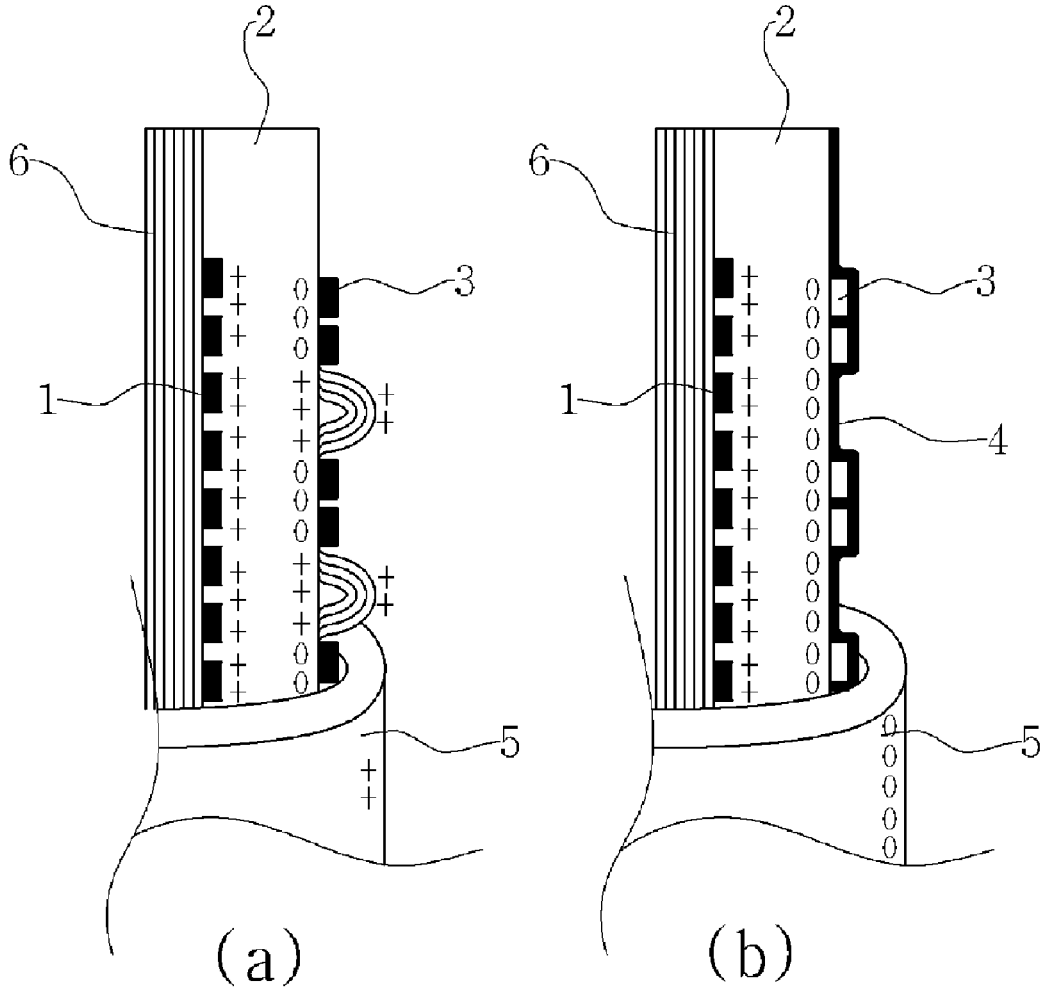
FIG. 18 is a conceptual view showing the principles of the leakage of an electric field from a heating cable and the blockage of an electric field of a heating cable having a conductive coating.

FIG. 18 is a conceptual view showing the principles of the leakage of an electric field from a heating cable and the blockage of an electric field of a heating cable having a conductive coating. Referring to FIG. 18, (a) illustrates the state in which a leaked electric field is formed when a conductive coating is not used, and (b) illustrates the state in which a conductive coating 4 blocks the formation of a leaked electric field.

If a lead wire is wound at regular intervals as the second electrical heating wire 3, or if a metallic copper foil is wound at regular intervals, portions at which the insulating coating 2 is externally exposed exist. A leaked electric field is externally formed through the portions. If the conductive coating 4 is applied to cover the insulating coating 2 and the second electrical heating wire 3, the conductive coating 4 shields portions, which cannot be entirely shielded by the second electrical heating wire 3, thus preventing the leaked electric field from being generated. Preferably, conductive synthetic resins are used as the conductive coating 4.

Meanwhile, if a metallic strip having a certain width or a plurality of lead wires is wound as the second electrical heating wire 3, the amount of leaked electric field generated decreases somewhat, so that a separate external coating 5 can be omitted, thus simplifying the manufacturing process and reducing the manufacturing cost.

The present invention is advantageous in that it can detect the overheating or short-circuit of first and second electrical heating wires between the electrical heating wires through a simple construction, thus enabling simple and inexpensive electric heating bedding or fomentation devices to be safely used.

Further, the present invention is advantageous in that it can simultaneously block a magnetic field and an electric field that are generated by a heating cable due to the shielding operation of a second electrical heating wire.

Further, the present invention is advantageous in that it can completely block even a slight electric field by utilizing a conductive coating, thus eliminating harmful effects on the human body.

Further, the present invention is advantageous in that it provides various types of heating cables capable of blocking both a magnetic field and an electric field.

What is claimed is:

1. A controller, having a safety device, for blocking electromagnetic waves, comprising:

a switch unit connected to a heating cable that blocks electromagnetic waves and includes a first electrical heating wire and a second electrical heating wire, the switch unit determining whether to supply power;

a heating current U-turn and detection unit for causing power input from the first electrical heating wire to make a U-turn to the second electrical heating wire and detecting a signal, wherein the heating current U-turn and detection unit comprises:

a heating current U-turn unit including a U-turn resistor for connecting an end of the first electrical heating wire to an end of the second electrical heating wire; and a U-turn current detection unit including a transistor, wherein the transistor of the U-turn current detection unit includes a base connected to both the U-turn resistor and the first electrical heating wire, an emitter connected to both the U-turn resistor and the second electrical heating wire, and a collector connected to a gate of the silicon controlled rectifier;

a fuse; and a cutting operation unit for culling the fuse depending on the signal detected by the heating current U-turn and detection unit, wherein the cutting operation unit comprises a silicon controlled rectifier and a heating resistor, wherein the silicon controlled rectifier of the cutting operation unit includes a cathode connected to the emitter of the transistor, and an anode connected to the heating resistor, wherein the heating resistor cuts the fuse when heat is generated.

2. The controller according to claim 1, wherein the switch unit comprises:

an off contact point for shutting off power;

a high contact point for strongly heating the heating cable; and a low contact point for relatively weakly heating the heating cable.

3. The controller according to claim 2, wherein the heating current U-turn and detection unit comprises:

a heating current U-turn unit including a U-turn rectifier for connecting an end of the first electrical heating wire to an end of the second electrical heating wire; and a U-turn current detection unit including a transistor.

4. The controller according to claim 3, wherein the heating current U-turn unit comprises a diode having an anode connected to both the first electrical heating wire and a cathode of the U-turn rectifier, and a cathode connected to both the second electrical heating wire and an anode of the U-turn rectifier.

5. The controller according to claim 3, wherein:

the cutting operation unit comprises a silicon controlled rectifier and a heating resistor, the transistor of the U-turn current detection unit includes a base connected to both the U-turn rectifier and the first electrical heating wire, an emitter connected to both the U-turn rectifier and the second electrical heating wire, and a collector connected to a gate of the silicon controlled rectifier, the silicon controlled rectifier of the cutting operation unit includes a cathode connected to the emitter of the transistor, and an anode connected to the heating resistor, and the heating resistor cuts the fuse when heat is generated.

6. The controller according to claim 2, wherein the heating current U-turn and detection unit comprises a solenoid for connecting an end of the first electrical heating wire to an end of the second electrical heating wire.

7. The controller according to claim 6, wherein the cutting operation unit comprises a lead switch operating depending on whether power of the solenoid is connected or disconnected.

8. The controller according to claim 7, wherein the cutting operation unit comprises a heating resistor, which is connected to the lead switch and cuts the fuse when heat is generated.

9. The controller according to claim 1, wherein:

the fuse is cut when overcurrent flows through the fuse, and the switch unit comprises, an off contact point for shutting off power, a high contact point for strongly heating the heating cable, and a low contact point for relatively weakly heating the heating cable.

10. The controller according to claim 9, wherein the heating current U-turn and detection unit comprises:

a heating current U-turn unit including a U-turn resistor for connecting an end of the first electrical heating wire to an end of the second electrical heating wire; and a U-turn current detection unit including a transistor.

11. The controller according to claim 10, wherein:

the cutting operation unit comprises a silicon controlled rectifier and a cutting rectifier, the transistor of the U-turn current detection unit includes a base connected to both the U-turn resistor and the first electrical heating wire, an emitter connected to both the U-turn resistor and the second electrical heating wire, and a collector connected to a gate of the silicon controlled rectifier, and the silicon controlled rectifier of the cutting operation unit includes a cathode connected to the emitter of the transistor, and an anode connected to the cutting rectifier.

12. The controller according to claim 9, wherein the heating current U-turn and detection unit comprises:

a heating current U-turn unit including a U-turn rectifier for connecting an end of the first electrical heating wire to an end of the second electrical heating wire; and a U-turn current detection unit including a transistor.

13. The controller according to claim 12, wherein the heating current U-turn unit comprises a diode having an anode connected to both the first electrical heating wire and a cathode of the U-mm rectifier and a cathode connected to both the second electrical heating wire and an anode of the U-turn rectifier.

14. The controller according to claim 12, wherein:

the cutting operation unit comprises a silicon controlled rectifier and a cutting rectifier, the transistor of the U-turn current detection unit includes a base connected to both the U-turn rectifier and the first electrical heating wire, an emitter connected to both the U-turn rectifier and the second electrical heating wire, and a collector connected to a gate of the silicon controlled rectifier, and the silicon controlled rectifier of the cutting operation unit includes a cathode connected to the emitter of the transistor and an anode connected to the cutting rectifier.

15. The controller according to claim 9, wherein the heating current U-turn and detection unit comprises a solenoid for connecting an end of the first electrical heating wire to an end of the second electrical heating wire.

16. The controller according to claim 15, wherein the cutting operation unit comprises a lead switch operating depending on whether power of the solenoid is connected or disconnected.

17. The controller according to claim 16, wherein the cutting operation unit comprises a cutting rectifier, which is connected to the lead switch.

* * * * *